United States Patent [19]

Mair et al.

[11] 4,052,037

[45] Oct. 4, 1977

[54] DRINKING CUP STRUCTURED TO ENHANCE BEVERAGE BLENDING

[75] Inventors: Barrie Mair, Maidenhead; Bernard Roy Schumann, Reading, both of England

[73] Assignee: Mars Limited, Slough, England

[21] Appl. No.: 362,673

[22] Filed: May 22, 1973

[30] Foreign Application Priority Data

May 26, 1972 United Kingdom ..... 25080/72

[51] Int. Cl. ..... B01f 1/00; B65d 3/06; B65d 21/02

[52] U.S. Cl. ..... 366/341; 206/217; 206/519; 229/1.5 B; 426/86

[58] Field of Search ..... 426/86, 134; 229/1.5 B; 220/97 C; 206/47 B, 217, 218, 519, 520; D7/6, 15; D9/220; 259/1 R, 18, 28

[56] References Cited

U.S. PATENT DOCUMENTS

| | | | |
|---|---|---|---|
| 1,025,206 | 5/1912 | Rounds | 259/18 UX |
| 2,971,304 | 2/1961 | O'Neil | 206/47 B X |
| 3,178,051 | 4/1965 | Edwards | 229/1.5 B X |
| 3,333,738 | 8/1967 | Goss | 206/47 B X |
| 3,353,707 | 11/1967 | Eyles | 209/1.5 B X |
| 3,397,867 | 8/1968 | Van't Hoff | 206/47 B X |
| 3,471,075 | 10/1969 | Wolf | 229/1.5 B |
| 3,485,412 | 12/1969 | Hawley | 220/97 C |
| 3,512,677 | 5/1970 | Kovac | 206/47 B X |
| 3,565,635 | 2/1971 | Mahlmann | 426/193 |
| 3,573,060 | 3/1971 | Casten et al. | 426/385 |
| 3,606,262 | 9/1971 | Van't Hoff | 229/1.5 B X |
| 3,625,704 | 12/1971 | Andre et al. | 426/193 X |
| 3,784,052 | 1/1974 | Edwards | 229/1.5 B X |

*Primary Examiner*—Frank W. Lutter
*Assistant Examiner*—Steven L. Weinstein
*Attorney, Agent, or Firm*—Davis, Hoxie, Faithfull & Hapgood

[57] ABSTRACT

A moulded plastics drinking cup for use in beverage vending machines and intended to contain powdered solid water-soluble or dispersible ingredients has a bottom formed as an upwardly directed cuspidal cone extending from the central region of the cup bottom to the sidewall without discontinuity. This shaping confers a desirable flow pattern on hot liquid injected into the cup in the machine and avoids mixing problems incurred with prior art cup bottoms. The conical form need not be complete but may be truncated to give a relatively flat central region that may be planar or domed. The bottom and side wall are preferably interconnected by a bevelled shoulder.

2 Claims, 1 Drawing Figure

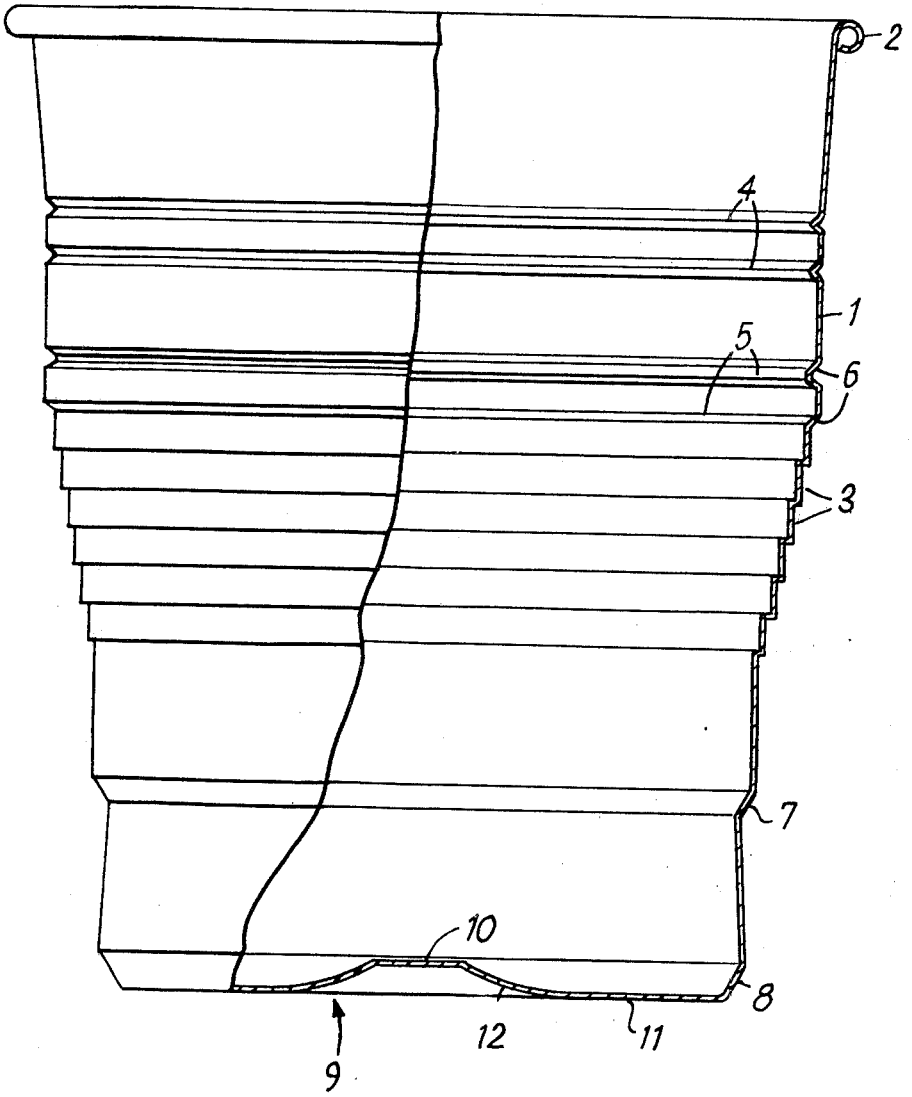
2
4
1
5
6
3
7
10
8
12
11
9

DRINKING CUP STRUCTURED TO ENHANCE BEVERAGE BLENDING

The present invention relates to the automatic or coin-operated vending of beverages prepared from powdered solid ingredients and a liquid such as water.

In conventional beverage vending machines beverages such as tea and coffee are prepared from powdered solid ingredients which are mixed in metered quantities with a metered quantity of hot water and are then dispensed into a cup. The cups are usually supplied to the machine in stacks and withdrawn one at a time from the stacks by appropriate mechanism.

The metering of solid ingredients requires mechanism or considerable bulk and complexity and it has been proposed to avoid this by enclosing appropriate quantities of dried ingredients in each cup of a stack to be delivered by the machine. It is then only necessary to meter hot water into a cup separated from the stack in order to obtain the complete beverage.

There are problems in obtaining adequate mixing of the solid ingredients with water or other liquid when the liquid is dispensed into a cup containing a layer of ingredients at the bottom. These problems relate to the two major factors determining the degree of dispersion of ingredients within the cup, the first factor being the inherent propensity of the ingredients to disperse and the second being the mixing action of the liquid upon contact with the ingredients and the cup.

The instrinsic dispersibility of a particulate ingredient is a function of both the constitution of the product substance and the form of its particle structure. In general, the lower the bulk density, the higher the degree of dispersibility, but full advantage cannot be taken of this relationship since it would require an unduly large volume to be available for ingredients and consequently an excessive height for a stack of a given number of cups containing such low bulk density ingredients.

We have now found that these problems can be alleviated by shaping the bottom of the cup to encourage dispersion. We have further found, in the case of freeze dried materials, that a critical range of particle size ensures an enhanced degree of dispersion, especially when ingredients conforming to this range are employed in the cups according to the invention.

We have observed that where the cup has a conventional flat bottom with a lower annular portion around its periphery, liquid dispensed on to the flat relatively raised central portion of the cup does not circulate freely in the lower periphery portion with the result that solid ingredients in the lower portion tend to remain unmixed. We have further found that with another form of cup having a bottom wholly or partly in the form of a right cone, interference with liquid flow at the intersection of the cone and the sidewall or the peripheral portion of the bottom leads to stagnant regions which inhibit thorough mixing.

In accordance with a first aspect of this invention it has now been found that significantly better mixing of liquid and solid ingredients is achieved where the cup has a bottom in the form of a cuspidal cone. That is to say, the substantially flat outer portion of the bottom merges imperceptibly and without discontinuity into a central portion of progressively increasing slope, the bottom thus having the general shape of a cone the sides of which in cross-section are concave upwards. The cross-section of the cone sides may, for example, be parabolic.

It is a feature of the base of cups according to the invention that in use the kinetic energy of the liquid is expended on the ingredients rather than on the cup structure. To achieve this the liquid, which usually enters the cup in a vertically downward direction, is caused to follow the contour of the cup base in such a way that there is minimal stagnation area upon initial impingement and thereafter the fluid flow is continuously and progressively turned through an angle of 90° from the vertical until it reaches the sidewall of the cup. Upon striking the sidewall of the cup, which is preferably bevelled into the base, the liquid is turned and the profile discontinuities introduced by the bevel induce turbulence in the hitherto predominantly laminar flow. In this way the ingredients are lifted clear of the base of the cup before complete mixing occurs, thus avoiding the formation of a barrier of semi-liquid slurry which would otherwise coat the lower layers of ingredients and inhibit solution.

The ideal profile to provide such a flow pattern is a cuspidal cone, but much of the advantage of the invention can be achieved with a truncated cuspidal cone, which is more convenient in practice. A rounded truncation gives smoother flow in the centre, but a flat top is satisfactory, especially since the liquid in a vending machine is metered not from a point source but in a jet of appreciable width.

With cups according to the invention it is possible to get excellent mixing of conventional spray-dried and freeze-dried materials as beverage constituents, especially if the latter have a particle size within the critical range hereinafter defined. More importantly, sugar can be escapsulated in the cup with the other ingredient without prejudice to the quality of the end product.

Because the solid ingredients are to be stored within the cups to be eventually used for the vended beverage, it is necessary that each successive cup should seal the ingredients into the cup next below it in the stack in order that the essential flavour of the ingredients should not be lost. For this purpose the cups may have internal and external projections which engage one another in the stack to provide the necessary seal and preferably also to hold the cups together in the stack without the need for additional wrappers.

In accordance with a further aspect of the invention it has been found that the average particle size of freeze-dried materials should lie in the range of 200 to 800 microns and it is preferred that there should be substantially no particles having a particle size less than 10 microns or more than 800 microns.

In the case of coffee and tea, the dried ingredients will be a mix of freeze-dried coffee or tea together with a dried milk of non-dairy whitener and sugar. The sugar and whitener can be employed in ordinary commercially available forms but it has been found that an outstanding better result is achieved if the freeze-dried ingredients are ground to a particle size within the quoted range. If the particle size is too coarse, as in the case with normal freeze-dried materials, difficulty is experienced in wetting out the mixture with the liquid and the volume occupied by the necessary quantity is excessive. If the particles are too small, however, they form a tightly packed lattice which resists the entry of water under the force which usually obtains in vending machines. Furthermore, the behavior of extremely small particles of 10 microns and less is dictated more by intersurface than gravitional forces and leads to problems which may be popularly ascribed to "static."

The invention will be further described by way of example with reference to the accompanying drawing which is side elevation, partly cut away, of a cup embodying the first aspect of this invention.

The cup shown in the drawing is a disposible, thermoformed plastics container made of an appropriate thermoplastic material such as polystyrene. Its side wall 1 terminates at its upper edge in a thickened rolled rim 2 and is provided in its central portion with steps or fins, such as those shown at 3, to assist the user in gripping the cup.

Towards the upper region of the side wall are a pair of inwardly projecting beads 4 which extend circumferentially round the side wall 1. At a lower position on the side wall are further circumferential mouldings 5 which present externally a pair of surfaces 6 complementary to the beads 4. The beads and the further mouldings are spaced apart by the distance with which adjacent cups are spaced in the stack and interlock to maintain the integrity of the stack.

Towards the base of the wall 1 is a sloping downwardly directed external shoulder 7, below which the side wall flares downwardly to a further and correspondingly angled shoulder or bevel 8 at the bottom of the cup. When the cups are stacked, the shoulder 8 on the upper of two adjacent cups contacts the inner surface of the shoulder 7 and the flared base of the upper cup provides a stopper or seal for the contents of the flared bottom portion of the lower cup.

The bottom 9 of the cup, which is formed integrally with the side wall, has a raised flat central portion 10 of relatively small diameter which is connected with an outer flat region 11 by a shallow cuspidal conical portion 12. It has been found that the use of a cuspidal conical form for this part of the bottom of the cup achieves enhanced mixing of liquid and solid ingredients, especially when the liquid is dispensed on to the central portion 10. This shape of base shows substantial advantages not only over flat bottom cups but also over cups having bottoms of pure conical form.

The following are examples of the practical application of the second aspect of the invention. For the production of tea, freeze-dried tea solids of 1mm particle size are taken and ground to an average particle size of 420 microns. When the ground material is mixed with commercially available dried milk or non-dairy whitener powder and optionally with sugar, it is found that a ½-inch layer of the mixture disperses quickly and completely in a stream of hot water discharged into the cup at the rate of approximately 1.2 fluid ounces per second, especially when the cup has the form shown in the drawing.

Similarly coffee can be prepared from a coarse freeze-dried coffee solids product by grinding it to an average particle size of 420 microns and mixing it optionally with milk or other whitener powder and sugar as before.

We claim:

1. A drinking cup adapted to facilitate the blending of a liquid with a charge of dry beverage ingredients stored in the bottom of the cup, the said cup being of the type having a general frustoconical side wall and a bottom wall joined to said side wall integrally therewith, the improvement characterized by the bottom wall having a relatively flat raised central area and a generally annular area extending outwardly from said central area to said side wall, said annular area having an upwardly concave cuspidal conical portion contiguous to and extending outwardly and downwardly from said central area and a flat portion merging with said concave portion and extending outwardly therefrom to a juncture with the said side wall, the juncture being formed as an annular shoulder flaring outwardly and upwardly to join the bottom and side walls at obtuse angles therewith.

2. A drinking cup according to claim 1 adapted for ready dispensability from a nest of like cups similarly charged, wherein the said side wall presents a downwardly directed external shoulder, spaced above the container bottom to afford a repository for the dry beverage charge, flaring downwardly toward said juncture to abut the said juncture of the next inner cup of the nest, thereby to seal the dry beverage ingredients with which the cup is charged.

* * * * *

UNITED STATES PATENT AND TRADEMARK OFFICE

CERTIFICATE OF CORRECTION

PATENT NO. : 4,052,037
DATED : October 4, 1977
INVENTOR(S) : BARRIE MAIR et al.

It is certified that error appears in the above-identified patent and that said Letters Patent are hereby corrected as shown below:

Column 1, line 16, "or" should be--of--.

Column 2, line 35, "escapsulated" should be--encapsulated--.

Column 2, line 35, "ingredient" should be--ingredients--.

Column 3, line 1, "gravitional" should be--gravitational--.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*